US010435232B2

(12) United States Patent
Hokanson et al.

(10) Patent No.: US 10,435,232 B2
(45) Date of Patent: Oct. 8, 2019

(54) COOPERATIVE PACKAGING SYSTEMS AND METHODS

(71) Applicant: Kohler Co., Kohler, WI (US)

(72) Inventors: Stephen C. Hokanson, Sheboygan Falls, WI (US); Tobin J. Vetting, Sheboygan Falls, WI (US); Steven Raden, Kohler, WI (US)

(73) Assignee: KOHLER CO., Kohler, WI (US)

( * ) Notice: Subject to any disclaimer, the term of this patent is extended or adjusted under 35 U.S.C. 154(b) by 214 days.

(21) Appl. No.: 15/482,345

(22) Filed: Apr. 7, 2017

(65) Prior Publication Data

US 2018/0290819 A1 Oct. 11, 2018

(51) Int. Cl.

| | |
|---|---|
| ***B65D 85/48*** | (2006.01) |
| ***B65D 81/05*** | (2006.01) |
| ***B65D 5/50*** | (2006.01) |
| *B65D 5/42* | (2006.01) |

(52) U.S. Cl.

CPC ..... *B65D 85/48* (2013.01); *B65D 5/5069* (2013.01); *B65D 81/056* (2013.01); *B65D 5/4266* (2013.01); *B65D 2571/00086* (2013.01); *B65D 2571/00111* (2013.01)

(58) Field of Classification Search

CPC .... B65D 85/48; B65D 5/5069; B65D 5/5021; B65D 81/05; B65D 81/053; B65D 81/056; B65D 81/055; B65D 81/054; B65D 2571/00111; B65D 5/4266; B65D 5/5028

USPC ..... 206/586, 453, 454, 325, 321, 521

See application file for complete search history.

(56) References Cited

U.S. PATENT DOCUMENTS

| | | | | |
|---|---|---|---|---|
| 5,307,928 A * | 5/1994 | Bishop | B65D 5/5033 | 206/320 |
| 7,883,179 B2 * | 2/2011 | Cha | B41J 2/14233 | 347/20 |
| 8,739,974 B2 * | 6/2014 | TeVault | B65D 81/055 | 206/586 |
| 8,777,009 B2 * | 7/2014 | Nakase | B65D 81/113 | 206/454 |
| 2002/0025404 A1 * | 2/2002 | Taber | B32B 3/12 | 428/118 |
| 2008/0148692 A1 * | 6/2008 | Wisecarver | B65D 5/5021 | 53/462 |
| 2009/0065385 A1 * | 3/2009 | Kakuta | B65D 81/113 | 206/316.1 |
| 2012/0074823 A1 * | 3/2012 | Bezich | A47B 87/0292 | 312/240 |

* cited by examiner

*Primary Examiner* — Steven A. Reynolds
(74) *Attorney, Agent, or Firm* — Foley & Lardner LLP

(57) ABSTRACT

A cooperative packaging system includes a base package, a first member, a second member, and a third member. The base package includes a first side and a second side. The second side is contiguous with the first side. The first member covers a portion of the first side of the base package. The second member covers the second side of the base package. The third member covers the first member and a portion of the second member. The first member and the second member are configured to mitigate impacts sustained by the cooperative packaging system prior to the impacts being transferred to the base package.

18 Claims, 18 Drawing Sheets

COOPERATIVE PACKAGING SYSTEMS AND METHODS

BACKGROUND

The present application relates generally to systems and methods for packaging. In particular, this application relates to cooperative packaging systems and methods.

Generally speaking, products that include framed glass are typically packaged using a wooden crate. For example, a shower door may be packaged in a wooden crate. These wooden crates may be held together with fasteners (e.g., screws, nails, etc.) that require tools (e.g., drills, pry bars, etc.) to disassemble. Accordingly, the process of removing the product from the wooden crate is often cumbersome and tedious. Further, these wooden crates are not easily recyclable, produce excess waste, and provide consumers with a significant inconvenience. Additionally, these wooden crates are expensive to manufacture and increase costs associated with the products.

SUMMARY

One embodiment of the present disclosure is related to a cooperative packaging system. The cooperative packaging system includes a base package, a first member, a second member, and a third member. The base package includes a first side and a second side. The second side is contiguous with the first side. The first member covers a portion of the first side of the base package. The second member covers the second side of the base package. The third member covers the first member and a portion of the second member. The first member and the second member are configured to mitigate impacts sustained by the cooperative packaging system prior to the impacts being transferred to the base package.

Another embodiment of the present disclosure is related to a cooperative packaging system. The cooperative packaging system includes a base package, a first member, a second member, and a third member. The base package includes a first side, a second side, a third side, a fourth side, a first surface, and a second surface. The second side is contiguous with the first side. The third side is contiguous with the second side. The fourth side is contiguous with the third side and the first side. The first surface is contiguous with the first side, the second side, the third side, and the fourth side. The second surface is contiguous with the first side, the second side, the third side, and the fourth side. The first member partially covers a portion of the first surface, a portion of the second surface, and a portion of the first side. The second member covers the second side and partially covers a portion of the first surface and a portion of the second surface. The third member covers the first member and partially covers the second member.

Yet another embodiment of the present disclosure is related to a process for assembling a cooperative packaging system. The process includes inserting a first member within a second member, inserting a third member within the second member, inserting a base package within the first member and the third member, inserting a fourth member within a fifth member, inserting a sixth member within the fifth member, placing the fourth member and the sixth member over the base package, and placing a band around the second member, the base package, and the fifth member such that the band biases the first member and the fourth member against the base package.

It is to be understood that both the foregoing general description and the following detailed description are exemplary and explanatory only and are not restrictive of the invention as claimed.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Currently shower doors and other similar products are shipped in wooden crates. These wooden crates are expensive, difficult to handle, and difficult for a consumer to unpack. For example, to unpack the wooden crate, pry bars, hammers, crow bars, drills, and other similar tools are often required to remove fasteners that are utilized to hold panels of the wooden crate together. Further, these wooden crates produce a large amount of waste. This waste takes up a large amount of space of a consumer's waste receptacle, and this waste is often partially, or completely, not recyclable.

An opportunity for increasing consumer satisfaction with the purchase of shower doors and other similar products exists by improving upon the standard wooden crate commonly used. The embodiments described herein are directed to a cooperative packaging system that optimizes the protection and unpacking experience of shower doors and other similar products. The cooperative packaging system described herein may meet certain requirements associated with the shipping of products (e.g., requirements of less than truckload shipping companies, requirements of parcel distribution companies, etc.). Further, the cooperative packaging system described herein may be partially or completely recyclable such that the cooperative packaging system is "environmentally friendly." In this way, the cooperative packaging system may reduce waste and enable a customer to increase the customer's recycling efforts.

Figure 1:
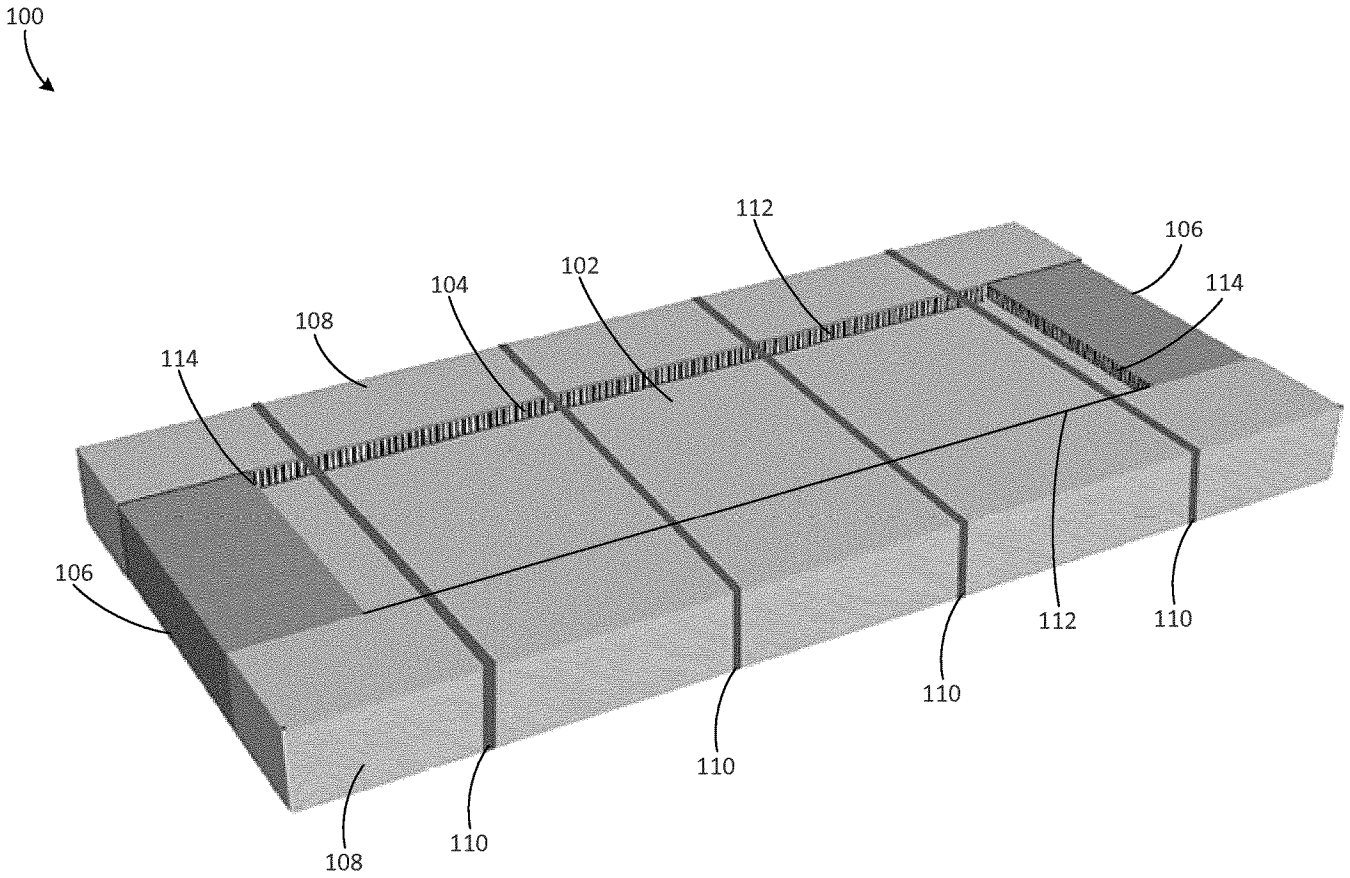
FIG. 1 is a top perspective view of a cooperative packaging system, according to an exemplary embodiment of the present disclosure.

Referring to FIG. 1, a packaging system (e.g., overpack, container system, shipping system, boxing system, etc.), shown as a cooperative packaging system 100, is shown. The cooperative packaging system 100 is used in the transportation and/or storage of a package (e.g., product, etc.), shown as base package 102. According to various embodiments, the base package 102 contains a product including a glass panel. For example, the base package 102 may contain a shower door. During transportation (e.g., shipping, moving, loading, etc.) or storage, the cooperative packaging system 100 may protect the base package 102 from various impacts (e.g., loading impacts, shock impacts, etc.). As shown in FIG. 1, the cooperative packaging system 100 is symmetrical.

According to an exemplary embodiment, the cooperative packaging system 100 includes a first pair of members (e.g., channels, etc.), shown as lateral members 104, a second pair of members (e.g., channels, etc.), shown as transverse members 106, a third pair of members, shown as encapsulating members 108, and a plurality of bands (e.g., ties, wraps, etc.), shown as bands 110. The lateral members 104 and the transverse members 106 surround the base package 102 such that the base package 102 is partially covered (e.g., overlapped, encapsulated, surrounded, etc.) by the lateral members 104 and the transverse member 106. The lateral members 104 and the transverse members 106 are U-shaped when utilized in the cooperative packaging system 100, each of the lateral members 104 and the transverse members 106 defining a pair of projections (e.g., arms, etc.) within which the base package 102 is received (e.g., covered, etc.). In various embodiments, the lateral members 104 are identical, the transverse members 106 are identical, and the encapsulating members 108 are identical.

Each of the encapsulating members 108 covers (e.g., surrounds, overlaps, encapsulates, contains, etc.) one of the lateral members 104 and partially covers (e.g., partially surrounds, partially overlaps, partially encapsulates, partially contains, etc.) both of the transverse members 106. The bands 110 are configured to surround the encapsulating members 108 such that the encapsulating members 108 are biased against the lateral members 104 which are further biased against the base package 102.

To remove the cooperative packaging system 100 from the base package 102 (e.g., to unpack the package, etc.) the bands 110 are removed first. For example, the bands 110 may be cut (e.g., through the use of a tool, etc.). Once the bands 110 are removed, the encapsulating members 108 are removed. In some applications, the lateral members 104 are removed along with the encapsulating members 108. In other applications, the lateral members 104 are removed after the encapsulating members 108 are removed. Once the lateral members 104 are removed, the transverse member 106 may be removed.

According to various embodiments, the cooperative packaging system 100 is graspable (e.g., configured to be grasped, configured to be grabbed, configured to be held, etc.) by a user (e.g., by a user's hand, etc.) along a first pair of edges (e.g., lip, etc.), shown as lateral edges 112, or a second pair of edges (e.g., lip, etc.), shown as transverse edges 114. The lateral edges 112 may be formed by a combination of the lateral member 104 and the encapsulating member 108. In various embodiments, the transverse edges 114 are formed by the transverse members 106. The configuration of the lateral members 104 and the encapsulating members 108 may increase a length of the lateral edges 112, thereby increasing a surface upon which the user can grasp. Further, the encapsulating member 108 may extend slightly beyond the lateral member 104 such that a lip is formed therebetween, the lip functioning to assist the user in grasping the lateral edges 112. Similarly, the transverse members 106 may be variously configured such that the transverse edges 114 are tailored for a target application.

In some applications, the cooperative packaging system 100 additionally or alternatively includes dedicated handholds, not shown, that may be grasped by a user to move the cooperative packaging system 100. For example, the cooperative packaging system 100 may include apertures (e.g., through the encapsulating members 108, through the lateral members 104, through the transverse members 106, etc.) that create graspable surfaces within the apertures. In another example, the cooperative packaging system 100 may include handles (e.g., plastic handles, straps, ropes, etc.) that are attached to the cooperative packaging system 100 (e.g., attached to the encapsulating member 108, attached to the lateral members 104, attached to the transverse members 106). In one example, the cooperative packaging system 100 includes plastic handles that include locking features, the plastic handles extending into apertures in the encapsulating members 108 such that the locking features engage the encapsulating members 108 and allow the cooperative packaging system 100 to be supported by the plastic handles.

According to various embodiments, the cooperative packaging system 100 is constructed from materials that protect the base package 102 from impacts sustained during transportation of the base package 102 (e.g., impacts sustained during shipment by a less than truckload carrier, impacts sustained during shipment by a parcel distribution company, etc.). For example, the lateral members 104 and the transverse members 106 may be configured to absorb impacts by providing localized crush zones that mitigate transfer of the impact to the base package. In various embodiments, the lateral members 104 and the transverse members 106 are constructed from Hexacomb® or honeycomb corrugate material which, the inventors present believe, exhibits optimal impact absorbing characteristics for the shipment of products such as shower doors. In various embodiments, the encapsulating members 108 are constructed from firm cardboard material. However, the encapsulating members 108 may also be constructed from various materials such as Hexacomb®, firm cardboard, wood, aluminum, plastic, polymers, composites, and other similar materials. In one example, the encapsulating members 108 are constructed from a relatively thin polymeric sheet.

The cooperative packaging system 100 may be partially or completely recyclable. For example, the cooperative packaging system 100 may be constructed from materials that are one-hundred percent recyclable. In other applications, the cooperative packaging system 100 is configured to be reusable.

Referring now to FIGS. 2-5, the cooperative packaging system 100 is shown in an exploded state. The encapsulating members 108 are configured to receive both the lateral members 104 and the transverse members 106. Similarly, the lateral members 104 and the transverse members 106 are configured to receive the base package 102. In this way, the lateral members 104, the transverse members 106, and the encapsulating members 108 cooperate to contain the base package 102 and bias the lateral members 104 against the base package 102 while maintaining the position of the transverse members 106.

Figure 2:
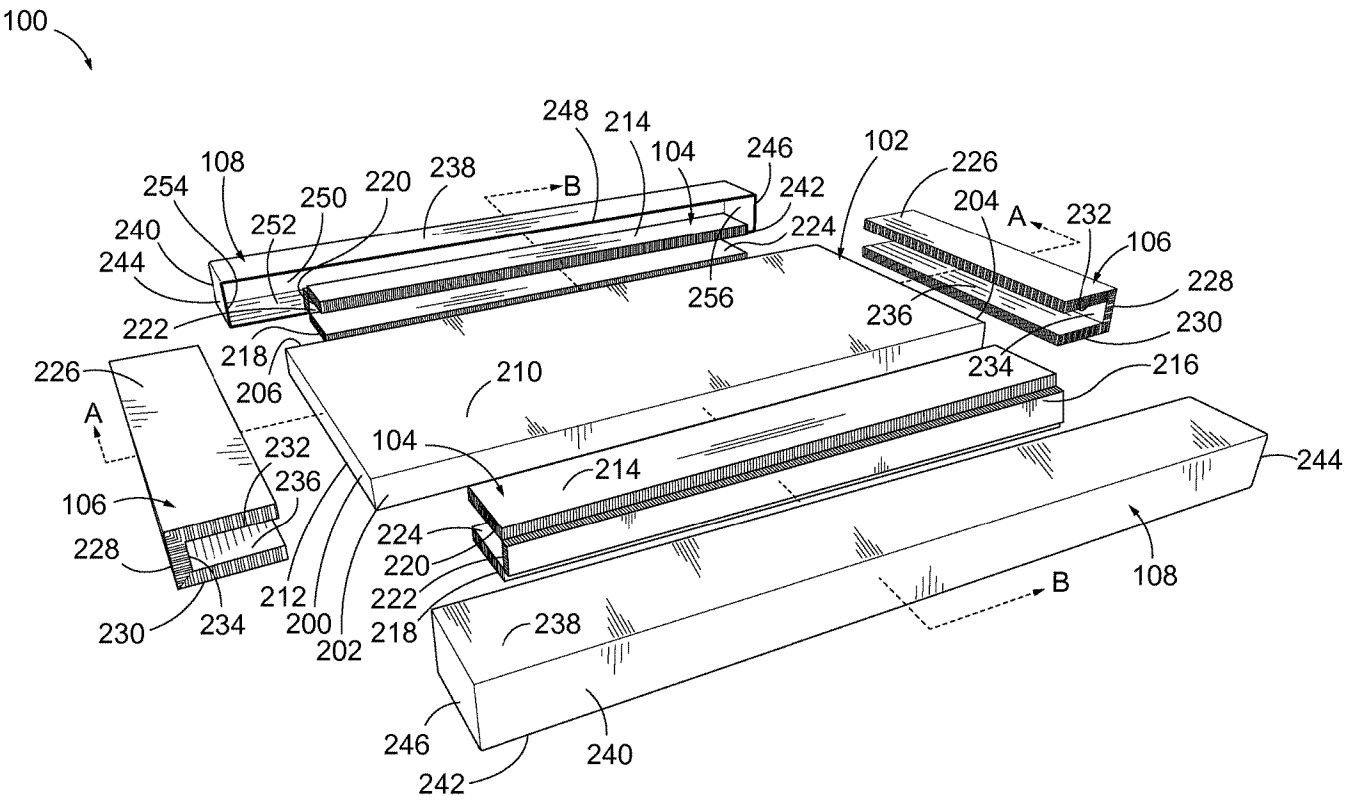
FIG. 2 is an exploded view of the cooperative packaging system shown in FIG. 1.
Figure 3:
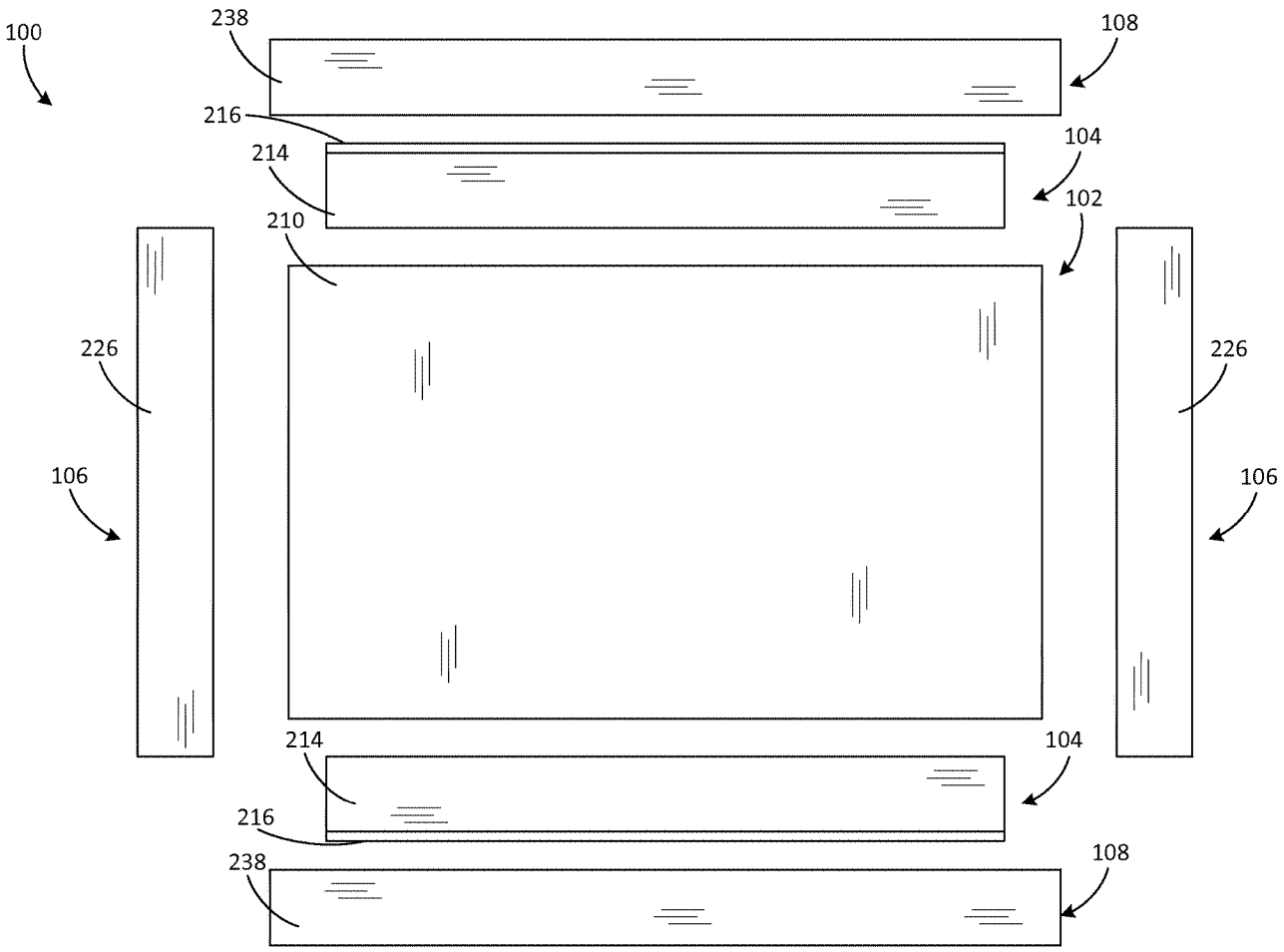
FIG. 3 is a top view of the cooperative packaging system shown in FIG. 2.
Figure 4:
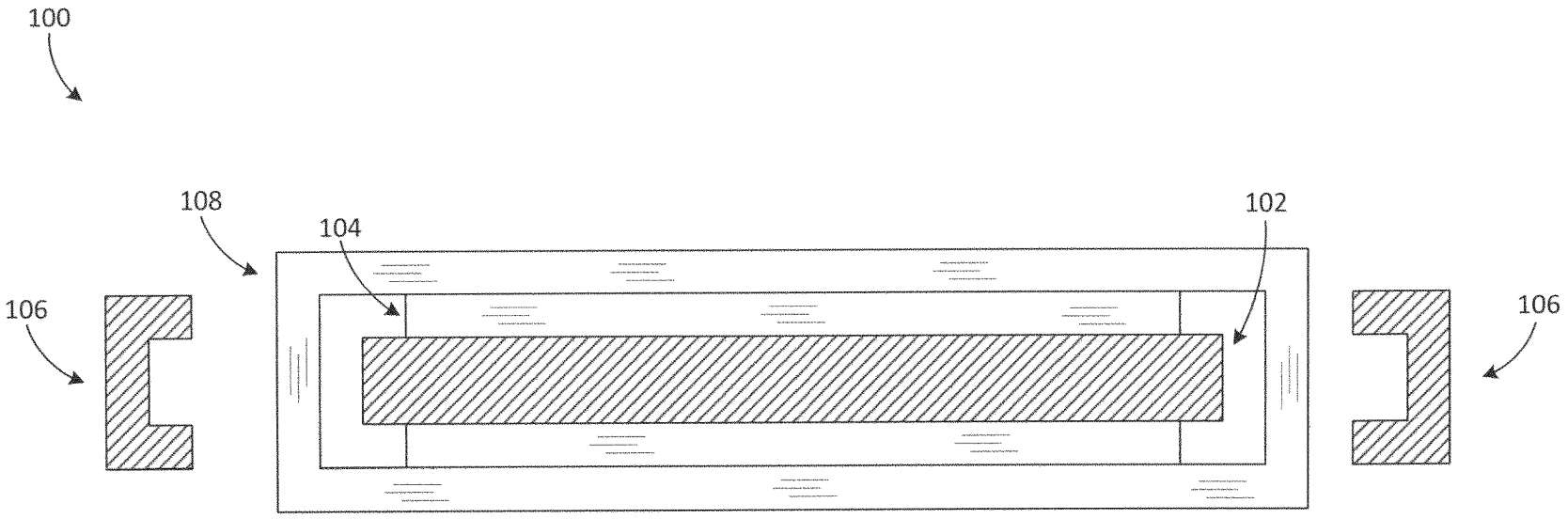
FIG. 4 is a cross-sectional view of the cooperative packaging system shown in FIG. 2 taken about line A-A.
Figure 5:
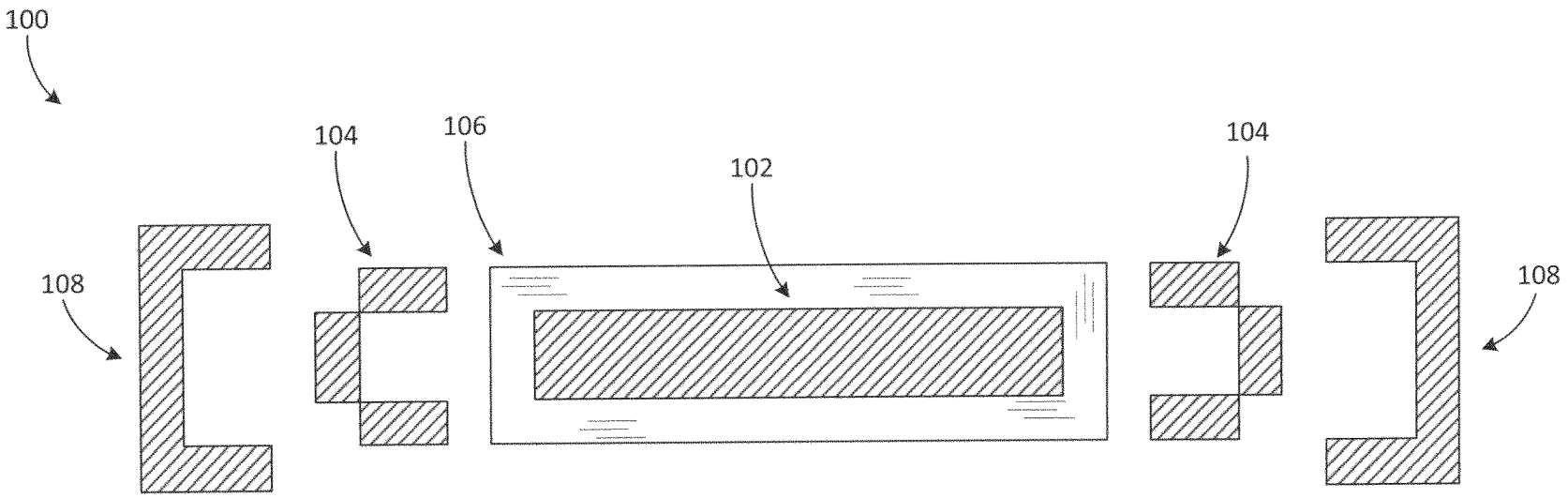
FIG. 5 is a cross-sectional view of the cooperative packaging system shown in FIG. 2 taken about line B-B.

As shown in FIG. 2, the base package 102 is rectangular and includes a first side (e.g., face, etc.), shown as a first side 200, a second side (e.g., face, etc.), shown as a second side 202, a third side (e.g., face, etc.), shown as a third side 204, and a fourth side (e.g., face, etc.), shown as a fourth side 206. The first side 200 may be parallel with the third side 204, and the second side 202 may be parallel with the fourth side 206. The base package 102 also includes another side, shown as a first face 210, and another side, shown as a second face 212. The first face 210 may define a first plane that is parallel to a second plane defined by the second face 212.

The lateral members 104 each include a first face (e.g., side, etc.), shown as a first face 214, a second face (e.g., side, etc.), shown as a second face 216, and a third face (e.g., side, etc.), shown as a third face 218. The second face 216 is contiguous with both the first face 214 and the third face 218. The first face 214, the second face 216, and the third face 218 cooperatively define an outer surface of one of the lateral members 104. The lateral members 104 each also include a fourth face (e.g., side, etc.), shown as a fourth face 220, a fifth face (e.g., side, etc.), shown as a fifth face 222, and a sixth face (e.g., side, etc.), shown as a sixth face 224. The fifth face 222 is contiguous with both the fourth face 220 and the sixth face 224. The fourth face 220, the fifth face 222, and the sixth face 224 cooperatively define an inner surface of one of the lateral members 104. The first face 214 may be disposed along any of a plane that is parallel to a plane upon which the third face 218 is disposed, a plane upon which the fourth face 220 is disposed, and a plane upon which the sixth face 224 is disposed. Similarly, the third face 218 may be disposed along a plane that is parallel to a plane upon which the fifth face 222 is disposed.

The transverse members 106 each include a first face (e.g., side, etc.), shown as a first face 226, a second face (e.g., side, etc.), shown as a second face 228, and a third face (e.g., side, etc.), shown as a third face 230. The second face 228 is contiguous with both the first face 226 and the third face 230. The first face 226, the second face 228, and the third face 230 cooperatively define an outer surface of one of the transverse members 106. The transverse members 106 each also include a fourth face (e.g., side, etc.), shown as a fourth face 232, a fifth face (e.g., side, etc.), shown as a fifth face 234, and a sixth face (e.g., side, etc.), shown as a sixth face 236. The fifth face 234 is contiguous with both the fourth face 232 and the sixth face 236. The fourth face 232, the fifth face 234, and the sixth face 236 cooperatively define an inner surface of one of the transverse members 106. The first face 226 may be disposed along any of a plane that is parallel to a plane upon which the third face 230 is disposed, a plane upon which the fourth face 232 is disposed, and a plane upon which the sixth face 236 is disposed. Similarly, the third face 230 may be disposed along a plane that is parallel to a plane upon which the fifth face 234 is disposed.

The encapsulating members 108 each include a first face (e.g., side, etc.), shown as a first face 238, a second face (e.g., side, etc.), shown as a second face 240, a third face (e.g., side, etc.), shown as a third face 242, a fourth face (e.g., side, etc.), shown as a fourth face 244, and a fifth face (e.g., side, etc.), shown as a fifth face 246. The first face 238 is contiguous with the second face 240, the fourth face 244, and the fifth face 246. The second face 240 is contiguous with the first face 238, the third face 242, the fourth face 244, and the fifth face 246. The third face 242 is contiguous with the second face 240, the fourth face 244, and the fifth face 246. The first face 238, the second face 240, the third face 242, the fourth face 244, and the fifth face 246 cooperative define an outer surface of one of the encapsulating members 108. The encapsulating members 108 each also include a sixth face (e.g., side, etc.), shown as a sixth face 248, a seventh face (e.g., side, etc.), shown as a seventh face 250, an eighth face (e.g., side, etc.), shown as an eighth face 252, a ninth face (e.g., side, etc.), shown as a ninth face 254, and a tenth face (e.g., side, etc.), shown as a tenth face 256. The sixth face 248 is contiguous with the seventh face 250, the ninth face 254, and the tenth face 256. The seventh face 250 is contiguous with the sixth face 248, the eighth face 252, the ninth face 254, and the tenth face 256. The sixth face 248, the seventh face 250, the eighth face 252, the ninth face 254, and the tenth face 256 cooperatively define an inner surface of one of the encapsulating members 108. The first face 238 may be disposed along any of a plane that is parallel to a plane upon which the third face 242 is disposed, a plane upon which the sixth face 248 is disposed, and a plane upon which the eighth face 252 is disposed. Similarly, the third face 242 may be disposed along a plane that is parallel to a plane upon which the seventh face 250 is disposed. Further, the fourth face 244 may be disposed along any of a plane that is parallel to a plane upon which the fifth face 246 is disposed, a plane upon which the ninth face 254 is disposed, and a plane upon which the tenth face 256 is disposed.

Figure 6:
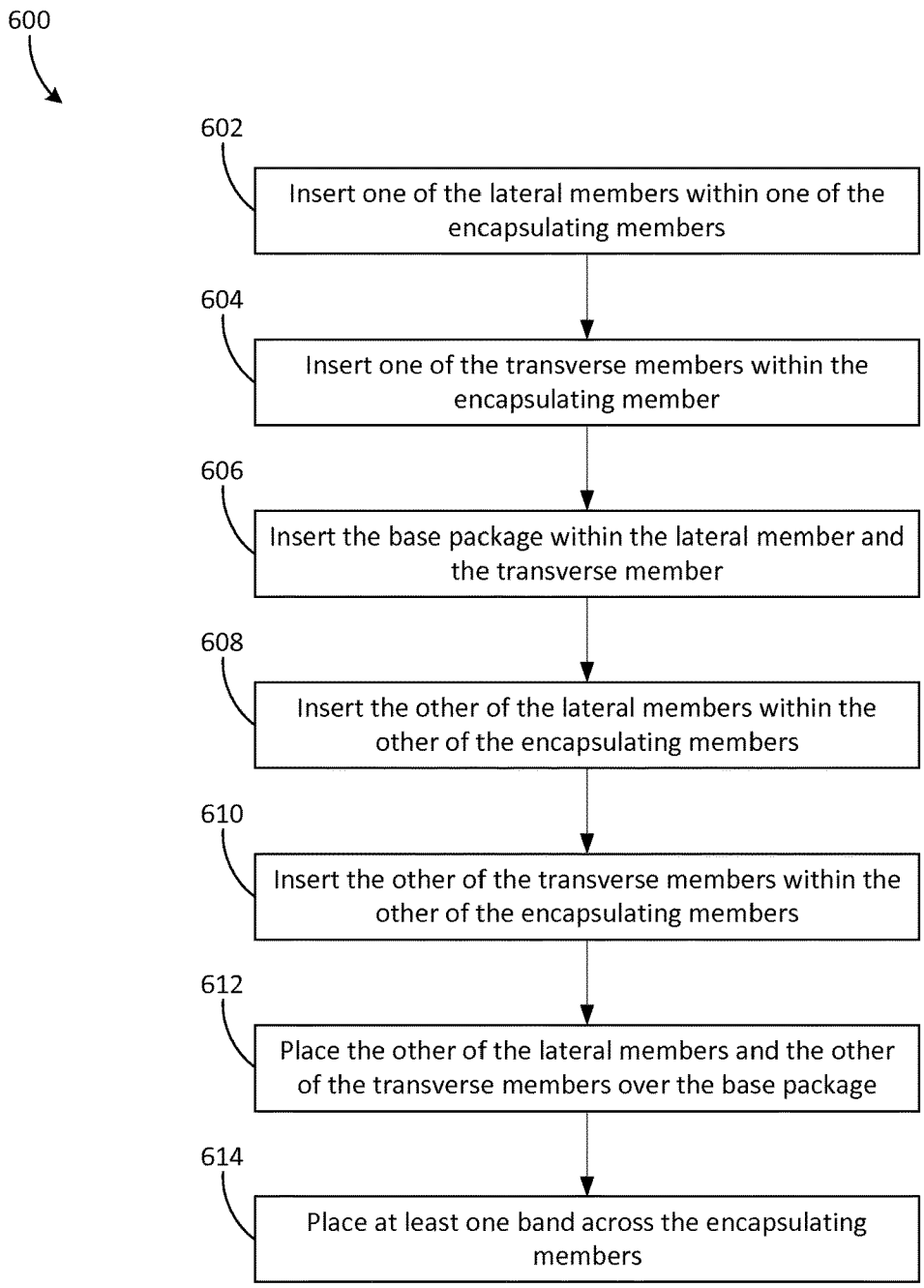
FIG. 6 is a flow diagram illustrating a process for assembling the cooperative packaging system shown in FIG. 1, according to an exemplary embodiment of the present disclosure.

Referring to FIG. 6, a process, shown as process 600, for assembling the cooperative packaging system 100 is described. While the process 600 is described herein, it is understood that various other processes for assembling the cooperative packaging system 100 are similarly possible (e.g., rearranging of the steps described hereinafter, etc.). When the cooperative packaging system 100 is assembled, various interactions between the base package 102, the lateral members 104, the transverse members 106, and the encapsulating members 108 occur. In step 602, one of the lateral members 104 is inserted within one of the encapsulating members 108. When the lateral member 104 is inserted within the encapsulating member 108, the first face 214, and second face 216, and the third face 218 of the lateral member 104 may contact, or be in confronting relation with, the sixth face 248, the seventh face 250, and the eighth face 252 of the encapsulating member 108, respectively. In an exemplary embodiment, the lateral member 104 is inserted within the encapsulating member 108 such that the lateral member 104 is approximately centered within the encapsulating member 108 and such that the second face 216 of the lateral member 104 contacts the seventh face 250 of the encapsulating member 108.

Next, in step 604, one of the transverse members 106 is inserted within the encapsulating member 108 between the lateral member 104 inserted within the encapsulating member 108 and the encapsulating member 108. At step 604, the transverse member 106 may contact, or in be in confronting relation with, both the lateral member 104 and the encapsulating member 108. Specifically, the first face 226 and the third face 230 of the transverse member 106 may contact, or be in confronting relation with, the sixth face 248 and the eighth face 252 of the encapsulating member 108, respectively. Additionally, the second face 228 of the transverse member 106 may contact, or be in confronting relation with, one of the ninth face 254 and the tenth face 256 of the encapsulating member 108. When the transverse member 106 and the lateral member 104 are both inserted within the encapsulating member, the fourth face 220 of the lateral member 104 may be disposed along a plane that is parallel to a plane upon which the fourth face 232 of the transverse member 106 is disposed and the sixth face 224 of the lateral member 104 may be disposed along a plane that is parallel to a plane upon which the sixth face 236 of the transverse member 106 is disposed. In an exemplary embodiment, the second face 228 of the transverse member 106 contacts the ninth face 254 of the encapsulating member 108, an end face of the transverse member 106 contacts the seventh face 250 of the encapsulating member 108, and a front face of the transverse member 106 contacts the lateral member 104.

In step 606, the base package 102 is inserted within the lateral member 104 and the transverse member 106 that are within the encapsulating member 108. The first face 210 of the base package 102 may contact, or be in confronting relation with, a combination of the fourth face 220 of the lateral member 104 and the fourth face 232 of the transverse member 106. Similarly, the second face 212 of the base package 102 may contact, or be in confronting relation with, a combination of the sixth face 224 of the lateral member 104 and the sixth face 236 of the transverse member 106. Further one of the second side 202 and the fourth side 206 of the base package 102 may contact, or be in confronting relation with, the fifth face 222 of the lateral member 104. Still further, one of the first side 200 and the third side 204 of the base package 102 may contact, or be in confronting relation with, the fifth face 234 of the transverse member 106. In an exemplary embodiment, the first face 210 of the base package 102 contacts the fourth face 220 of the lateral member 104 and the fourth face 232 of the transverse member 106, the second face 212 of the base package 102 contacts the sixth face 224 of the lateral member 104 and the sixth face 236 of the transverse member 106, and one of the second side 202 and the fourth side 206 of the base package 102 contact the fifth face 222 of the lateral member 104.

In step 608, the other of the lateral members 104 is inserted within the other of the encapsulating members 108, as described in step 602. In an exemplary embodiment, the other of the lateral members 104 is inserted within the other of the encapsulating members 108 such that the other of the lateral members 104 is approximately centered within the other of the encapsulating members 108 and such that the second face 216 of the other of the lateral members 104 contacts the seventh face 250 of the other of the encapsulating members 108.

In step 610, the other of the transverse members 106 is inserted within the other of the encapsulating members 108, as described in step 604. In an exemplary embodiment, the second face 228 of the other of the transverse members 106 contacts the ninth face 254 of the other of the encapsulating members 108, an end face of the other of the transverse members 106 contacts the seventh face 250 of the other of the encapsulating members 108, and a front face of the other of the transverse members 106 contacts the other of the lateral members 104.

In step 612, the other of the lateral members 104 and the other of the transverse members 106 is placed over the base package 102, such that the base package 102 is inserted within the other of the lateral members 104 and the other of the transverse member 106, as described in step 606. In an exemplary embodiment, the first face 210 of the base package 102 contacts the fourth face 220 of the other of the lateral members 104 and the fourth face 232 of the other of the transverse members 106, the second face 212 of the base package 102 contacts the sixth face 224 of the other of the lateral members 104 and the sixth face 236 of the other of the transverse members 106, and one of the second side 202 and the fourth side 206 of the base package 102 contact the fifth face 222 of the other of the lateral members 104.

In step 614, at least one of the bands 110 is placed across the encapsulating members 108. The bands 110 function to bias the encapsulating members 108 together, thereby holding the lateral members 104 against the base package 102 and containing the transverse members 106 between the encapsulating members 108. In some embodiments, the cooperative packaging system 100 includes a plurality of the bands 110. For example, the cooperative packaging system 100 may include two, three, four, five, or more of the bands 110. In use, a user may grasp the bands 110 to transport the cooperative packaging system 100.

Figure 7A:
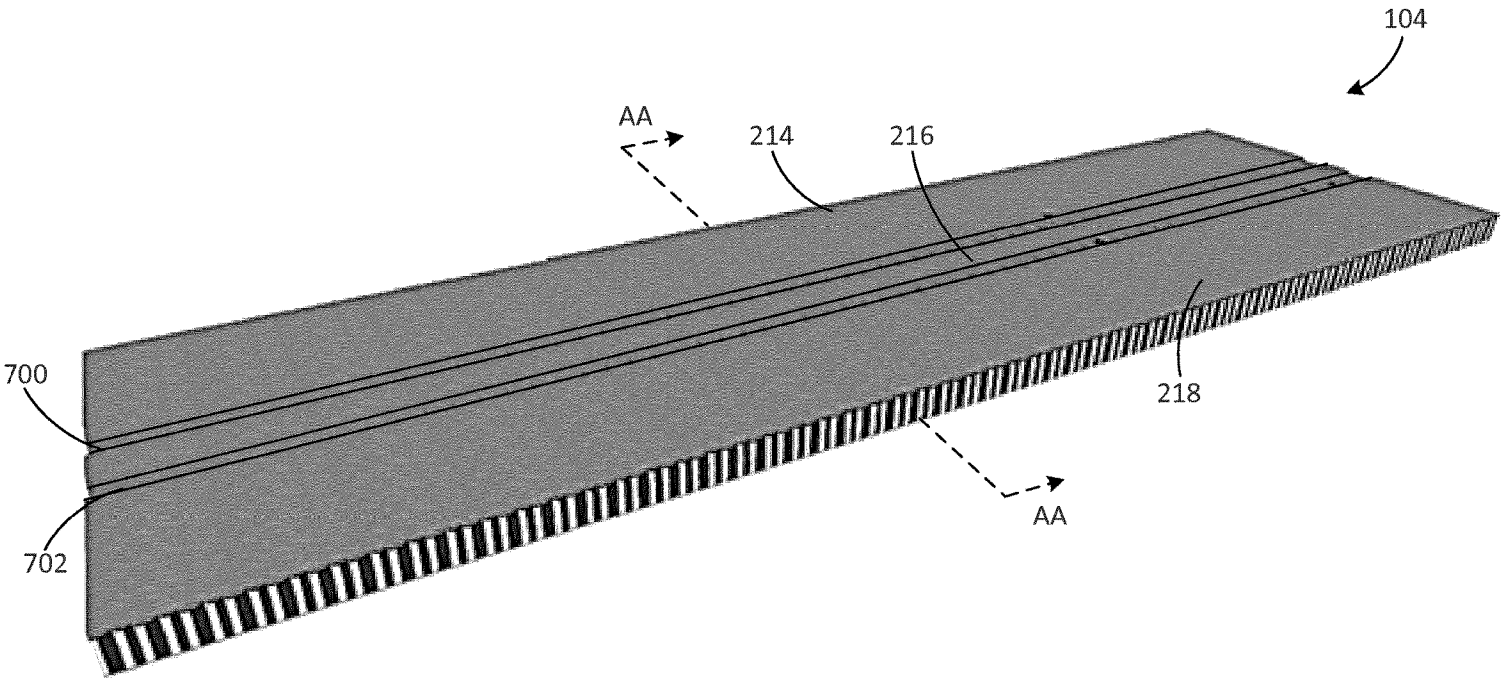
FIG. 7A is a top perspective view of a lateral member for the cooperative packaging system shown in FIG. 1, in a pre-form state, according to an exemplary embodiment of the present disclosure.
Figure 7B:
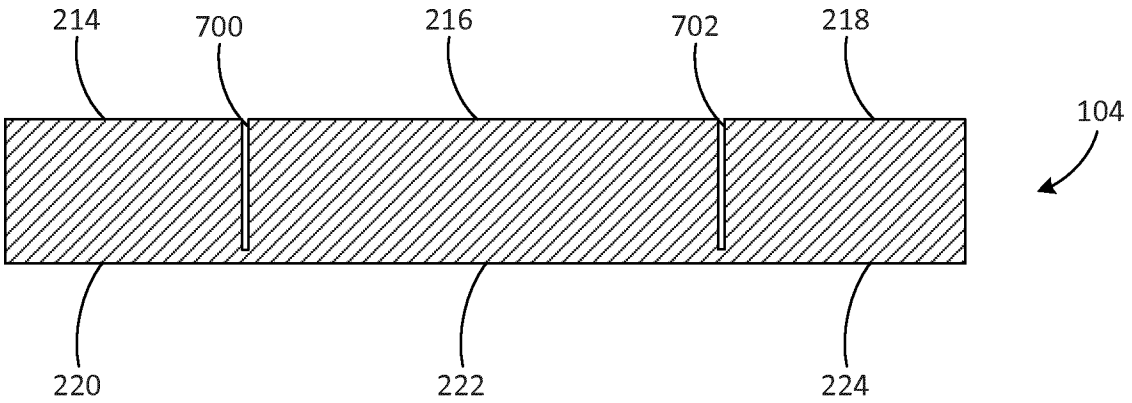
FIG. 7B is a cross-sectional view of the lateral member shown in FIG. 7A taken about line AA-AA.

FIGS. 7A-7D illustrate the lateral member 104 in a pre-form (e.g., blank, etc.) state, prior to be formed and subsequently utilized in the cooperative packaging system 100. As shown in the pre-form state, the lateral members 104 are formed from a straight sheet of shock absorbing material (e.g., honeycomb corrugate, Hexacomb®, etc.) that includes a first channel (e.g., cut, etc.), shown as a first channel 700, and a second channel (e.g., bend, cut, etc.), shown as a second channel 702. As shown in FIG. 7B, the first channel 700 and the second channel 702 are relatively narrow slits that extend almost completely through the lateral members 104. In various embodiments, the first channel 700 and the second channel 702 are defined by a depth (e.g., into the lateral members 704, etc.), that is significantly (e.g., substantially, etc.) greater than a width (e.g., from a first portion of the lateral member 704, across the first channel 700 and the second channel 702, and to a second portion of the lateral member 704). The first channel 700 separates the first face 214 of the lateral member 104 from the second face 216 of the lateral member 104. Similarly, the second channel 702 separates the second face 216 of the lateral member 104 from the third face 218 of the lateral member 104.

According to various embodiments, the first channel 700 and the second channel 702 are formed on the outer surface of the lateral members 104. The first channel 700 and the second channel 702 facilitate forming of the lateral member 104 while minimizing an amount of material required to form the lateral member 104. In an exemplary embodiment, the first channel 700 and the second channel 702 are formed through a partial cut into the lateral member 104. In other applications, the first channel 700 and the second channel 702 are formed by compression (e.g., via a die, via a roller, etc.). Advantageously, the encapsulating members 108 cover (e.g., overlap, encapsulate, etc.) the first channel 700 and the second channel 702, thereby providing the cooperative packaging system 100 with a clean, polished, and professional aesthetic appearance while decreasing costs associated with the manufacturing of the cooperative packaging system 100.

Figure 7C:
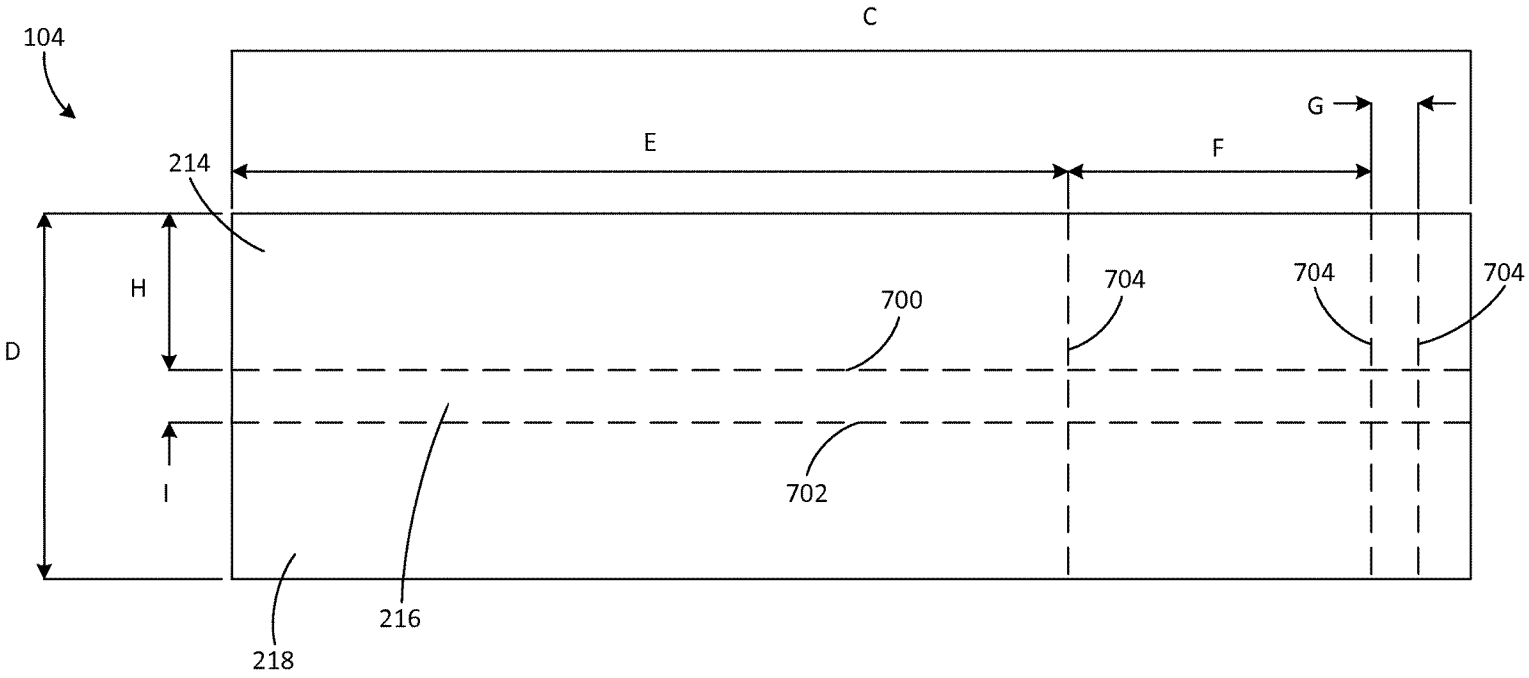
FIG. 7C is a top view of the lateral member shown in FIG. 7A.

In some applications, the lateral members 104 are provided to a manufacturer in a pre-form (e.g., blank, etc.) state such that the lateral members 104 may be tailored for a target application. As shown in FIG. 7C, the lateral members 104 includes perforations (e.g., tear-away cuts, etc.), shown as lines of perforations 704. The lines of perforations 704 span across the lateral members 104. The lines of perforations 704 allow a manufacturer to tear off a portion of the lateral members 104 such that the lateral members 104 are tailored to a target length for a target application. The lateral members 104 may be provided with, for example, one, two, three, four, or more lines of perforations 704.

Figure 7D:
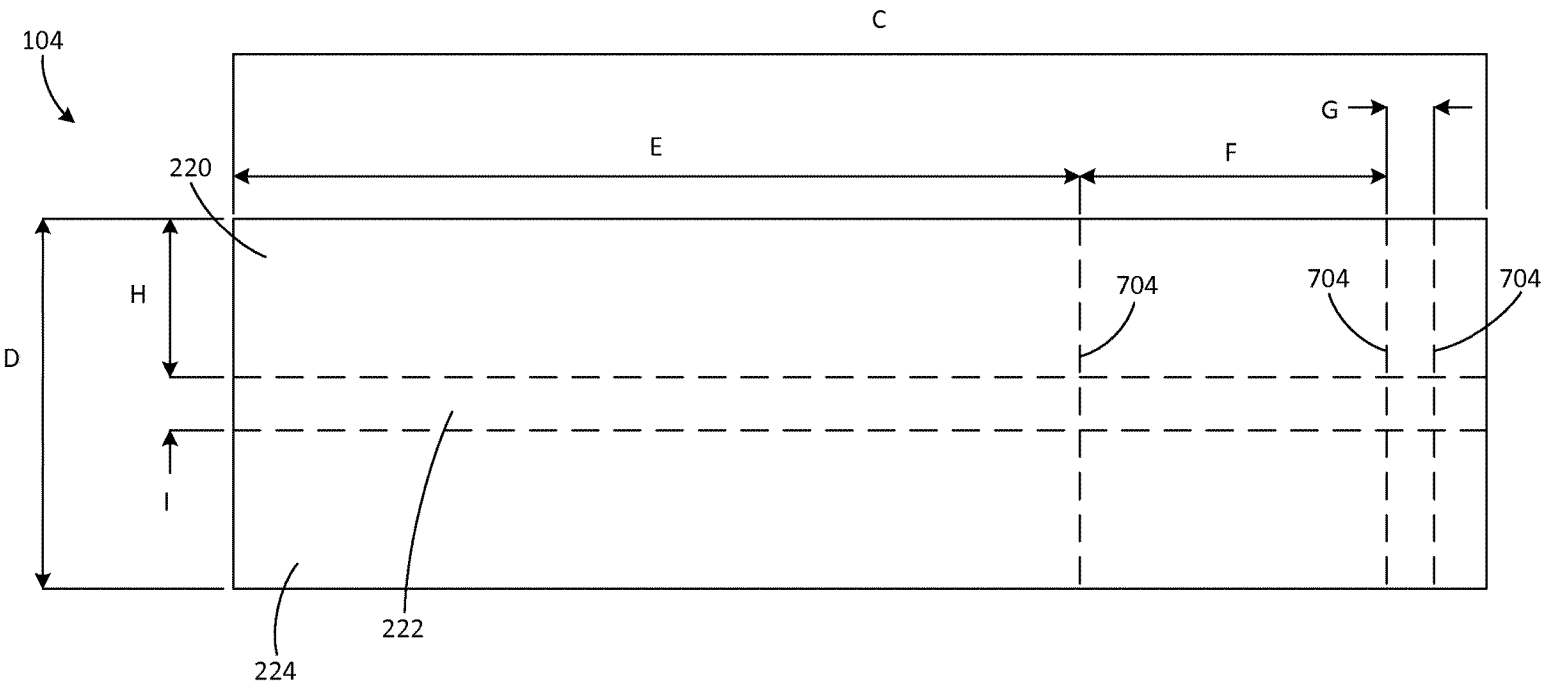
FIG. 7D is a bottom view of the lateral member shown in FIG. 7A.

The lateral members 104 are defined by a length C and a width D. The lateral members 104 are also defined by various lengths depending on the number and location of the lines of perforations 704. As shown in FIGS. 7C and 7D, the lateral members 104 are defined by a length E, a length F, and a length G. The lateral members 104 are also defined by a width H, which is a width of the first face 214 of the lateral member 104 and which is a width of the fourth face 220 of the lateral member 104, and a width I, which is a width of the second face 216 of the lateral member 104 and which is a width of the fifth face 222 of the lateral members 104. While various lengths and configurations are possible for the lateral members 104, Table 1 below demonstrates a few non-limiting examples of configurations of the lateral members 104.

TABLE 1

Dimensions for various configurations of the lateral members 104, in millimeters, according to several non-limiting embodiments.

| Example | C | D | E | F | G | H | I |
|---|---|---|---|---|---|---|---|
| 1 | 1644.65 | 482.60 | 1111.25 | 400.05 | 63.50 | 203.20 | 76.20 |
| 2 | 1644.65 | 498.48 | 1111.25 | 400.05 | 63.50 | 203.20 | 92.08 |
| 3 | 1644.65 | 536.57 | 1111.25 | 400.05 | 63.50 | 203.20 | 130.18 |
| 4 | 1644.65 | 511.18 | 1111.25 | 400.05 | 63.50 | 203.20 | 104.78 |

To form the lateral members 104 from the pre-form state that is shown in FIGS. 7A-7D, the lateral members 104 may be bent (e.g., deformed, pressed, etc.) into a channel or U-shape. For example, the lateral members 104 may be bent within a jig. When the lateral members 104 are bent, the fourth face 220 of the lateral member 104 is brought closer to the sixth face 224 of the lateral member 104. Further, as the lateral members 104 are bent, the first channel 700 and the second channel 702 expand, thereby facilitating the bending of the lateral members 104. The fourth face 220 of the lateral member 104 and the fifth face 222 of the lateral member 104 may form a first hinge which facilitates this bending of the lateral member 104. Similarly, the fifth face 222 of the lateral member 104 and the sixth face 224 of the lateral member 104 may form a second hinge with also facilitates this bending of the lateral member 104.

According to various embodiments, the length of the lateral members 104 when formed is less than the length of the second side 202 of the base package 102 and/or less than the length of the fourth side 206 of the base package 102 and the height of the lateral members 104 is substantially equal to, or slightly greater than, the length of height of the second side 202 of the base package 102 and/or substantially equal to, or slightly greater than, the height of the fourth side 206 of the base package 102.

In some alternative applications, at least one of the first channel 700 and the second channel 702 is formed on the inner surface of the lateral member 104 such that bending of the lateral member 104 causes compression of the at least one of the first channel 700 and the second channel 702. Further, the first channel 700 and/or the second channel 702 may be discontinuous along the inner surface and/or the outer surface of the lateral members 104. For example, the first channel 700 may include a first portion and a second portion, the first portion and the second portion interspaced by a portion of the lateral member 104 that does not include the first channel 700.

Figure 8A:
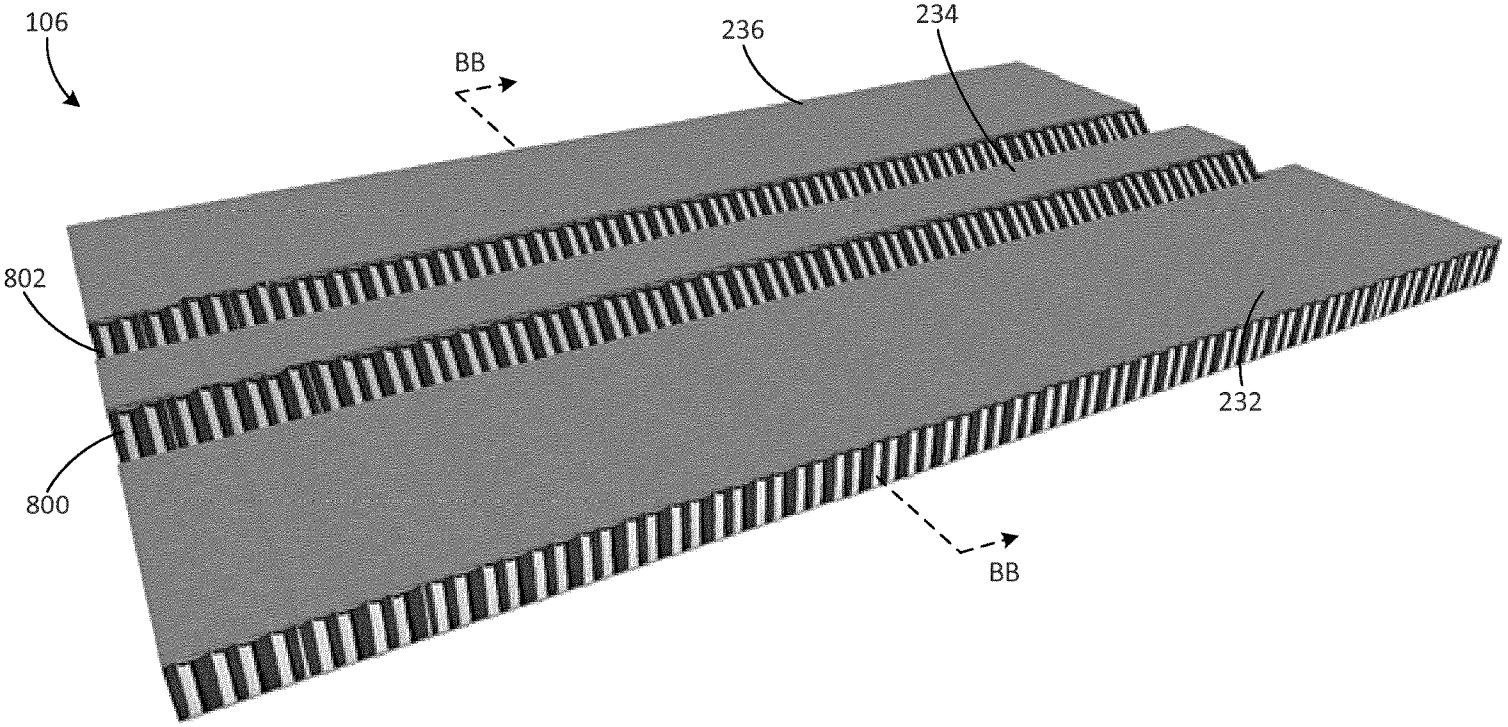
FIG. 8A is a top perspective view of a transverse member for the cooperative packaging system shown in FIG. 1, in a pre-form state, according to an exemplary embodiment of the present disclosure.
Figure 8B:
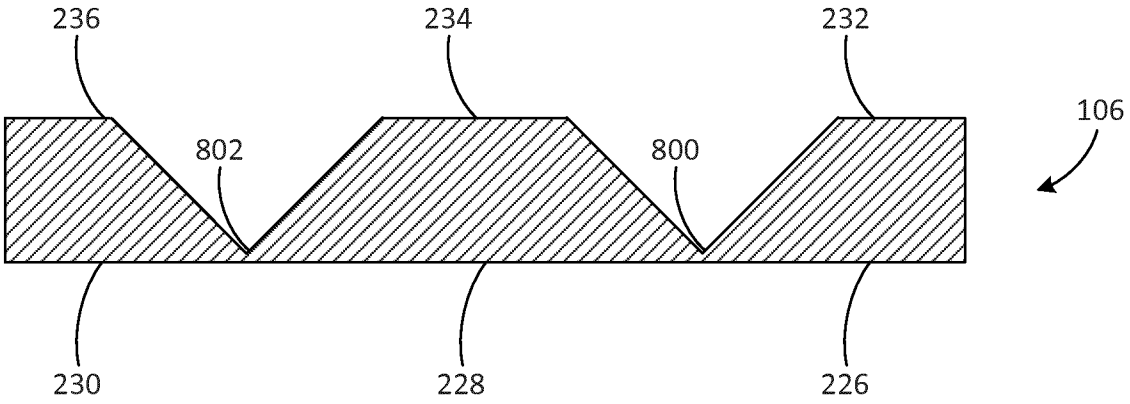
FIG. 8B is a cross-sectional view of the transverse member shown in FIG. 8A taken about line BB-BB.

FIGS. 8A-8D illustrate the transverse member 106 in a pre-form state, prior to be formed and subsequently utilized in the cooperative packaging system 100. As shown in the pre-form state, the transverse members 106 are formed from a straight sheet of material (e.g., honeycomb corrugate, Hexacomb®, etc.) that includes a first channel (e.g., cut, etc.), shown as a first channel 800, and a second channel (e.g., cut, etc.), shown as a second channel 802. The first channel 800 separates the fourth face 232 of the transverse member 106 from the sixth face 236 of the transverse member 106. Similarly, the second channel 802 separates the fifth face 234 of the transverse member 106 from the sixth face 236 of the transverse member 106. As shown in FIG. 8B, the first channel 800 and the second channel 802 are formed using a V-cut that extends almost completely through the transverse members 106.

According to various embodiments, the first channel 800 and the second channel 802 are formed on the inner surface of the transverse members 106. The first channel 800 and the second channel 802 facilitate forming of the transverse member 106. In some applications, the first channel 800 and the second channel 802 are formed by a series of cuts (e.g., via a blade, etc.). In still other applications, the transverse members 106 include additional channels, or may include only one of the first channel 800 and the second channel 802. The first channel 800 and the second channel 802 may also have various shapes, sizes and configurations. For example, the first channel 800 and the second channel 802 may be angle shaped, semi-circular, trapezoidal, or have other similar shapes.

Figure 8C:
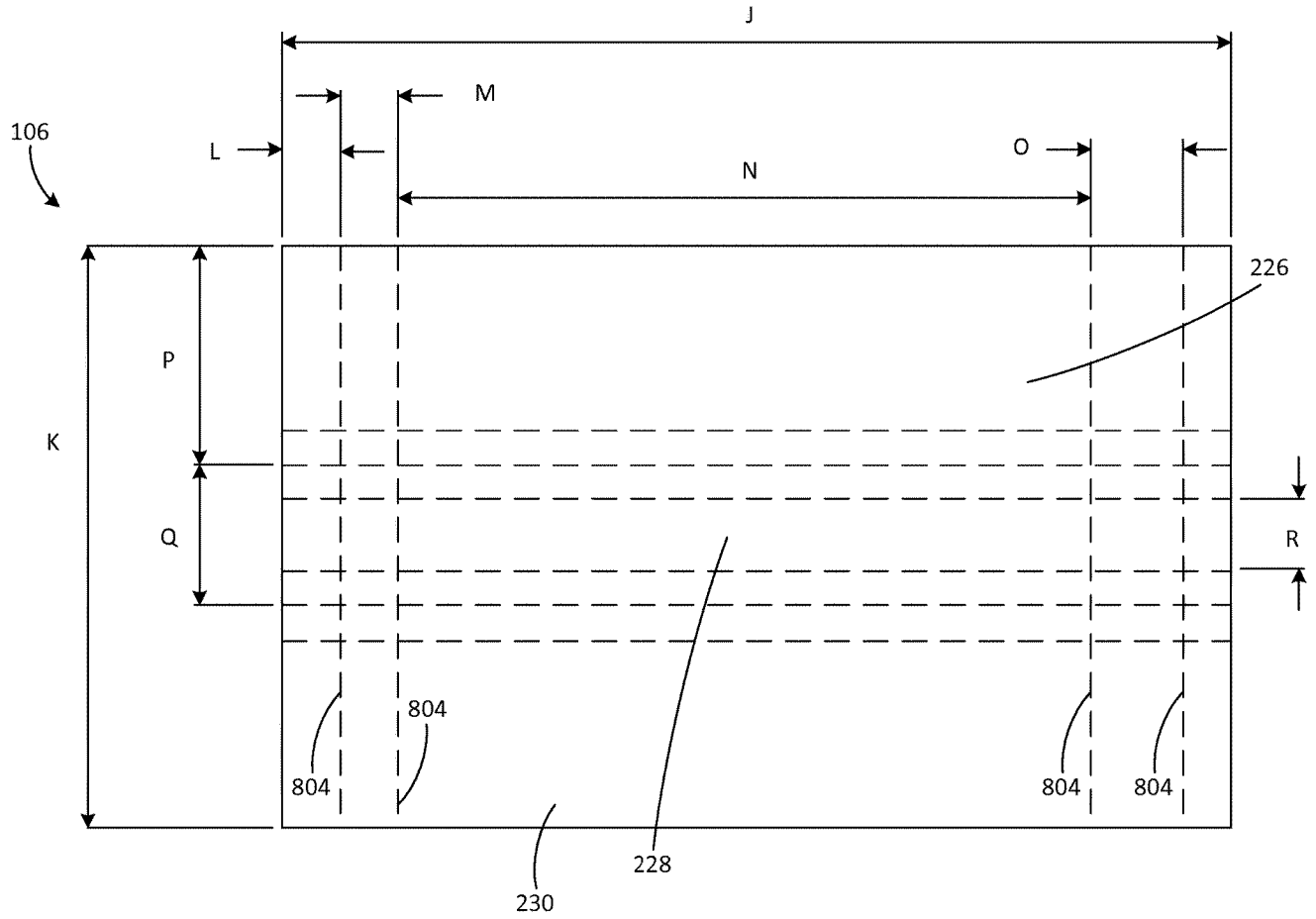
FIG. 8C is a top view of the transverse member shown in FIG. 8A.

In some applications, the transverse members 106 are provided to a manufacturer in a pre-form (e.g., blank, etc.) state such that the transverse members 106 may be tailored for a target application. As shown in FIG. 8C, the lateral members 104 includes perforations (e.g., tear-away cuts, etc.), shown as lines of perforations 804. The lines of perforations 804 span across the transverse members 106. The lines of perforations 804 allow a manufacturer to tear off a portion of the transverse members 106 such that the transverse members 106 are tailored to a target length for a target application. The transverse members 106 may be provided with, for example, one, two, three, four, or more lines of perforations 804.

Figure 8D:
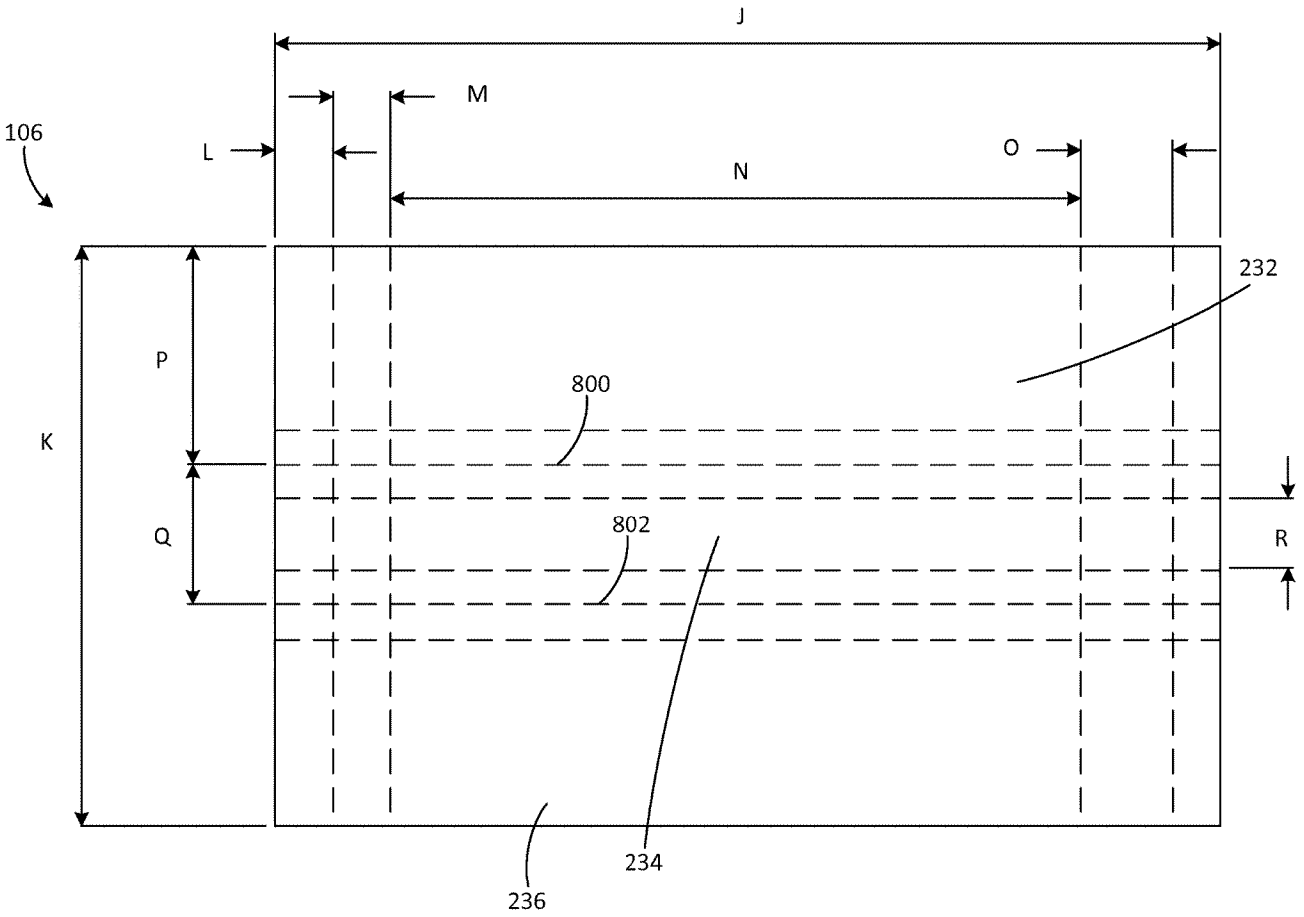
FIG. 8D is a bottom view of the transverse member shown in FIG. 8A.

The transverse members 106 are defined by a length J and a width K. The transverse members 106 are also defined by various lengths depending on the number and location of the lines of perforations 804. As shown in FIGS. 8C and 8D, the transverse members 106 are defined by a length L, a length M, a length N, a length O, a width P, a width Q, and a width R. The width R is a width of the second face 228 of the transverse members 106 and a width of the fifth face 234 of the transverse members 106. While various lengths and configurations are possible for the transverse members 106, Table 2 below demonstrates a few non-limiting examples of configurations of the transverse members 106.

TABLE 2

Dimensions for various configurations of the transverse members 106, in millimeters, according to several non-limiting embodiments.

| Example | J | K | L | M | N | O | P | Q | R |
|---|---|---|---|---|---|---|---|---|---|
| 1 | 1041.40 | 635.00 | 63.50 | 63.50 | 762.00 | 101.60 | 241.30 | 152.40 | 76.20 |
| 2 | 1041.40 | 650.87 | 63.50 | 63.50 | 762.00 | 101.60 | 241.30 | 168.28 | 84.14 |
| 3 | 1041.40 | 688.97 | 63.50 | 63.50 | 762.00 | 101.60 | 241.30 | 206.37 | 130.18 |
| 4 | 1041.40 | 663.57 | 63.50 | 63.50 | 762.00 | 101.60 | 241.30 | 180.97 | 104.78 |

To form the transverse members 106 from the pre-form state that is shown in FIGS. 8A-8D, the transverse members 106 may be bent (e.g., deformed, pressed, etc.) into a channel or U-shape. For example, the transverse members 106 may be bent within a jig. When the transverse members 106 are bent, the fourth face 232 of the transverse member 106 is brought closer to the sixth face 236 of the transverse member 106. Further, as the transverse members 106 are bent, the first channel 800 and the second channel 802 compress and are eventually close or substantially close, thereby facilitating the bending of the transverse members 106. The first face 226 of the transverse member 106 and the second face 228 of the transverse member 106 may form a first hinge which facilitates this bending of the transverse member 106. Similarly, the second face 228 of the transverse member 106 and the third face 230 of the transverse member 106 may form a second hinge with also facilitates this bending of the transverse member 106.

According to various embodiments, the length of the transverse members 106 when formed is substantially equal to, or slightly greater than, the length of the first side 200 of the base package 102 or substantially equal to, and/or slightly greater than the length of the third side 204 of the base package 102 and the height of the lateral members 104 is substantially equal to, or slightly greater than, the length of height of the first side 200 of the base package 102 and/or substantially equal to, or slightly greater than, the height of the third side 204 of the base package 102.

In some alternative applications, at least one of the first channel 800 and the second channel 802 are formed on the outer surface of the transverse member 106 such that bending of the transverse member 106 causes expansion of the at least one of the first channel 800 and the second channel 802. Further, the first channel 800 and/or the second channel 802 may be discontinuous along the inner surface and/or the outer surface of the transverse members 106. For example, the first channel 800 may include a first portion and a second portion, the first portion and the second portion interspaced by a portion of the transverse member 106 that does not include the first channel 800.

Figure 9A:
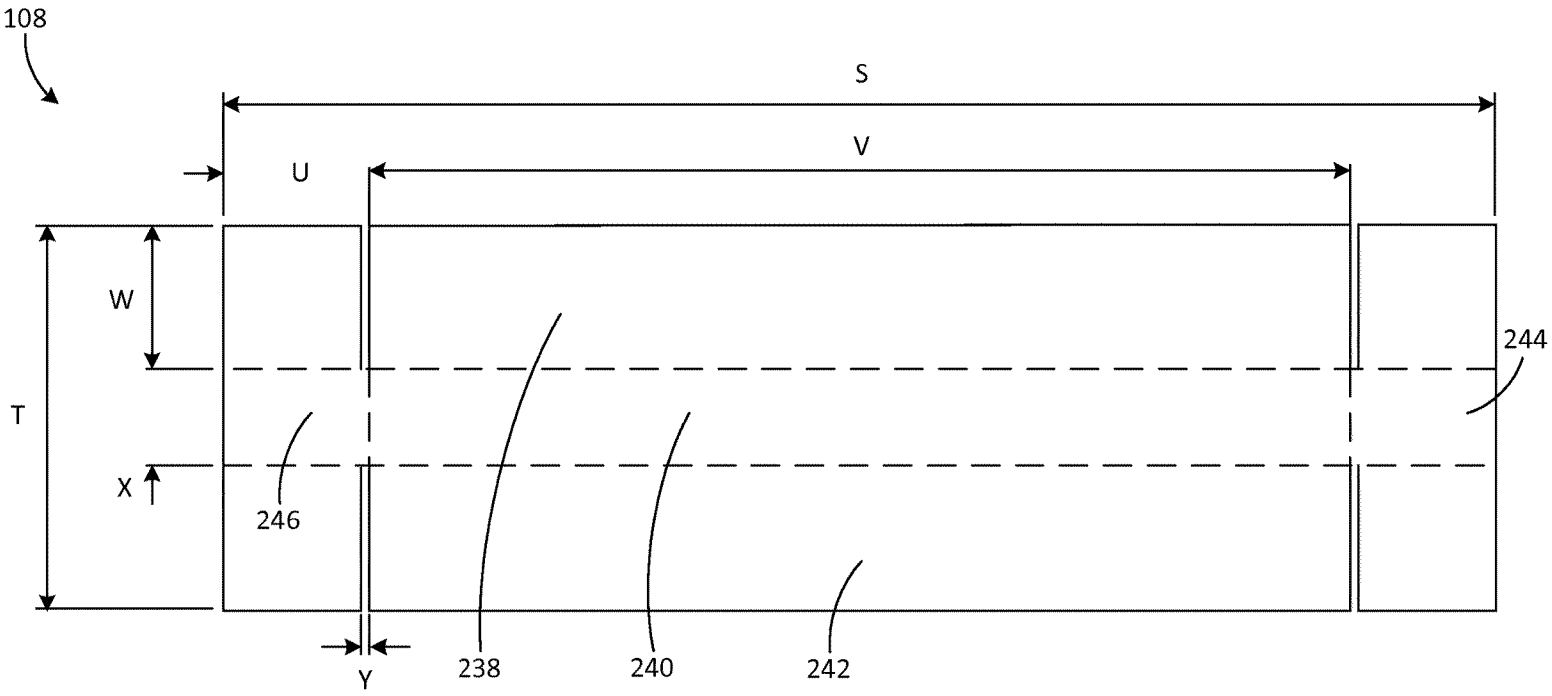
FIG. 9A is a top view of an encapsulating member for the cooperative packaging system shown in FIG. 1, in a pre-form state, according to an exemplary embodiment of the present disclosure.
Figure 9B:
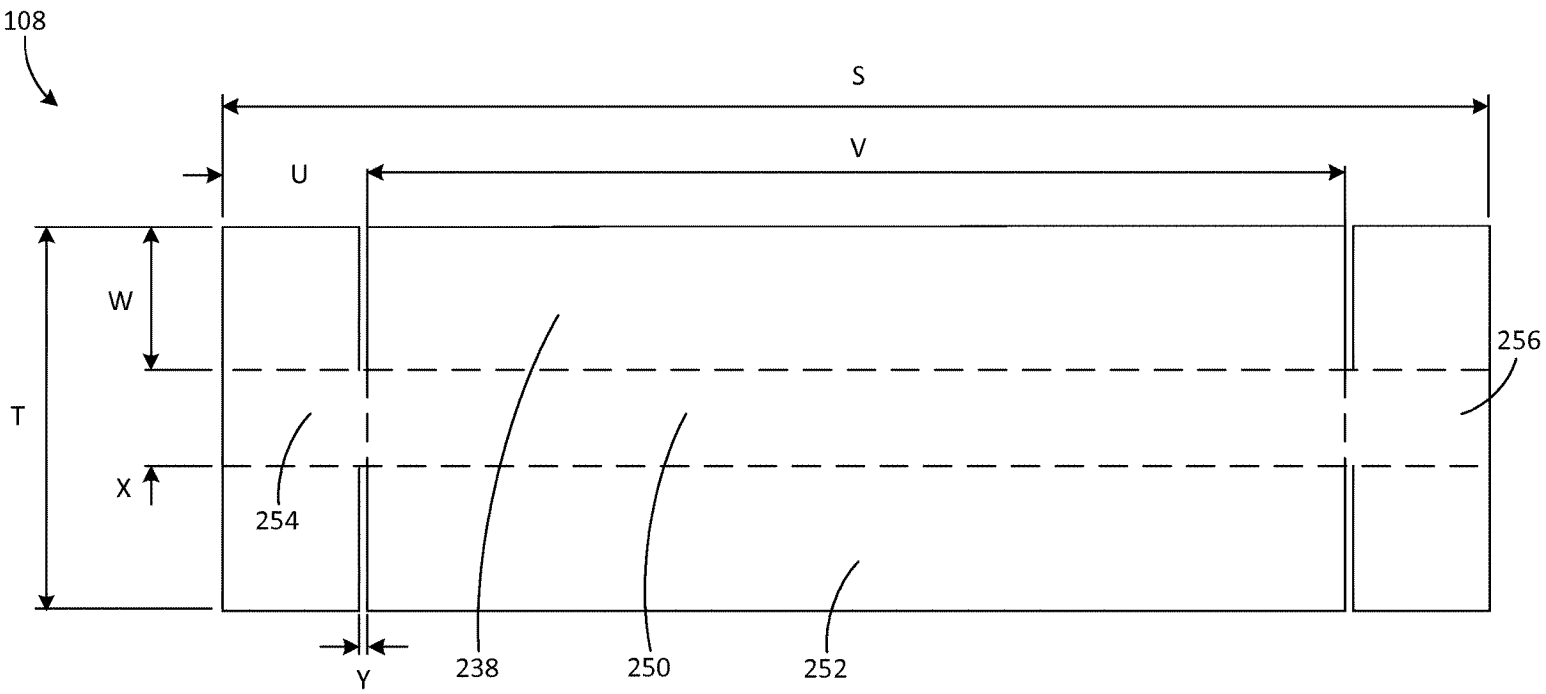
FIG. 9B is a bottom view of the encapsulating member shown in FIG. 9A.

FIGS. 9A and 9B illustrate the encapsulating member 108 in a pre-form state, prior to be formed and subsequently utilized in the cooperative packaging system 100. As shown in the pre-form state, the encapsulating members 108 are formed from a straight sheet of material (e.g., cardboard, etc.). In some applications, the encapsulating members 108 include various channels, channels, and other structures having various shapes (e.g., angle shaped, semi-circular, trapezoidal, etc.), sizes and configurations.

In some applications, the encapsulating members 108 are provided to a manufacturer in a pre-form state such that the encapsulating members 108 may be tailored for a target application. The encapsulating members 108 are defined by a length S and a width T, while the formed encapsulating members 108 are defined by a length V, a height X, and a depth U. The encapsulating members 108 are also defined by a length W and a length Y. While various lengths and configurations are possible for the encapsulating members 108, Table 3 below demonstrates a few non-limiting examples of configurations of the encapsulating members 108.

TABLE 3

Dimensions for various configurations of the encapsulating members 108, in millimeters, according to several non-limiting embodiments.

| Example | S | T | U | V | W | X | Y |
|---|---|---|---|---|---|---|---|
| 1 | 2141.54 | 642.94 | 242.89 | 1655.76 | 242.89 | 157.16 | 9.53 |
| 2 | 2636.84 | 642.94 | 242.89 | 2151.06 | 242.89 | 157.16 | 9.53 |
| 3 | 2636.84 | 658.81 | 242.89 | 2151.06 | 242.89 | 173.04 | 9.53 |
| 4 | 2636.84 | 671.51 | 242.89 | 2151.06 | 242.89 | 185.74 | 9.53 |
| 5 | 2636.84 | 696.91 | 242.89 | 2151.06 | 242.89 | 211.14 | 9.53 |

To form the encapsulating members 108 from the pre-form state that is shown in FIGS. 9A and 9B, the encapsulating members 108 may be bent (e.g., deformed, pressed, etc.) into a channel or U-shape. For example, the encapsulating members 108 may be bent within a jig. When the encapsulating members 108 are bent, the fourth face 232 of the transverse member 106 is brought closer to the sixth face 236 of the transverse member 106. When the encapsulating members 108 are bent, the sixth face 248 of the encapsulating member 108 is brought closer to the eighth face 252 of the encapsulating member 108 and the ninth face 254 of the encapsulating member 108 is brought closer to the tenth face 256 of the encapsulating member 108.

According to various embodiments, the length of the encapsulating members 108 when formed is slightly greater than (e.g., by two times the thickness of the transverse members 106, etc.) the length of the second side 202 of the base package 102 or slightly greater than (e.g., by two times the thickness of the transverse members 106, etc.) the length of the fourth side 206 of the base package 102, and the height of the encapsulating members 108 is slightly greater than (e.g., by two times the thickness of the transverse members 106, etc.) the length of height of the second side 202 of the base package 102 and/or slightly greater than (e.g., by two times the thickness of the transverse members 106, etc.) the height of the fourth side 206 of the base package 102.

In some alternative applications, at least one of the encapsulating members 108 include lines of perforations which facilitate selective tailoring of the encapsulating members 108 for a target application. For example, the lines of perforations facilitate tearing of the encapsulating members 108 along the lines of perforations.

Figure 10:
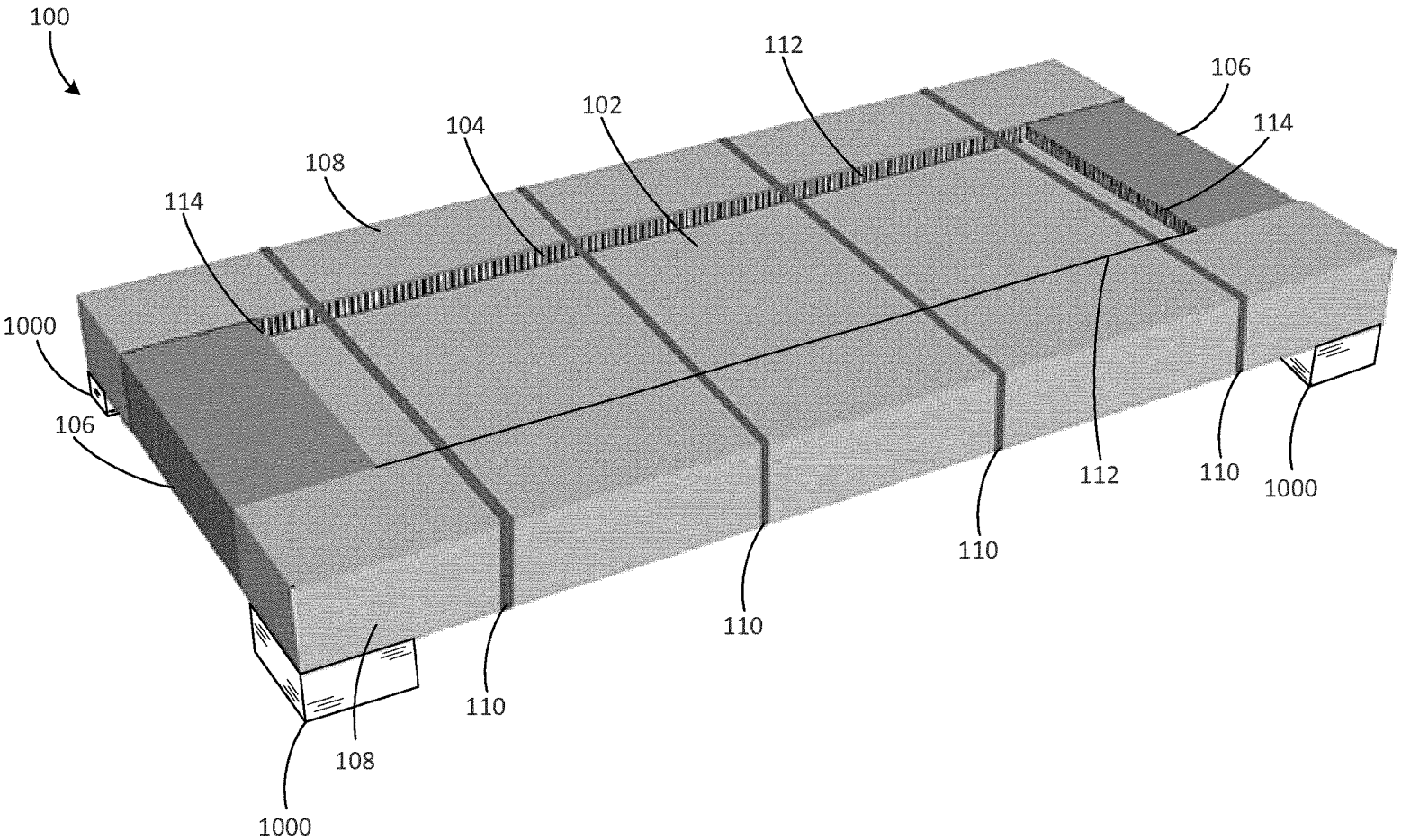
FIG. 10 is a top perspective view of the cooperative packaging system shown in FIG. 1 including risers, according to an exemplary embodiment of the present disclosure.

As shown in FIG. 10, the cooperative packaging system 100 further includes a plurality of structures, shown as risers

1000. The risers 1000 elevate the cooperative packaging system 100 from the ground such that various implements (e.g., fork lift tangs, etc.) may slide underneath the cooperative packaging system 100 and/or between a surface and the cooperative packaging system 100. According to various embodiments, the cooperative packaging system 100 includes four of the risers 1000. The risers 1000 may all be identical and disposed proximate to each of the corners of the cooperative packaging system 100. Additionally or alternatively, the cooperative packaging system 100 may be moved by engaging at least one of the bands 110. For example, implements (e.g., fork lift tangs, etc.) may slide between the bands 110 and the cooperative packaging system 100. The risers 1000 may be adhered (e.g., glued, attached, etc.) to the encapsulating member 108 and/or the transverse member 106. Alternatively, the risers 1000 may be adhered to the base package 102.

Figure 11:
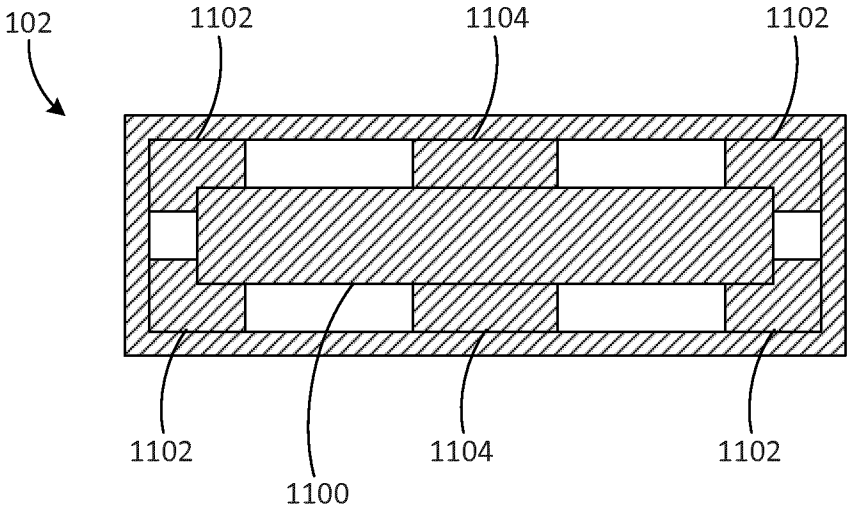
FIG. 11 is a cross-sectional view of a base package for the cooperative packaging system shown in FIG. 1, according to an exemplary embodiment of the present disclosure.

As shown in FIG. 11, the base package 102 includes a product (e.g., purchased product, shower door, etc.), shown as product 1100, a plurality of first inserts (e.g., spacers, etc.), shown as corner inserts 1102, and a plurality of second inserts (e.g., spacers, etc.), shown as spacers 1104. According to an exemplary embodiment, the product 1100 is a shower door. The product 1100 may include a glass panel. The corner inserts 1102 are positioned around corners of the product 1100. For example, if the product 1100 has eight corners, the base package 102 may include eight corner inserts 1102 positioned around each of the eight corners. The spacers 1104 may be positioned between the base package 102 and the product. For example, the spacers 1104 may be positioned in the center of the base package 102. The spacers 1104 may be positioned over glass panels of the product 1100. The corner inserts 1102 and the spacers 1104 may be constructed from a foam (e.g., a high density foam, a low density foam, etc.), a corrugate material (e.g., Hexacomb®, etc.) or other similar packaging material.

The corner inserts 1102 and the spacers 1104 cooperate to protect and insulate the product 1100 from impacts to the base package 102. The corner inserts 1102, the spacers 1104, the lateral members 104, and the transverse members 106 cooperatively mitigate impact to the product 1100. For example, an impact may occur on the lateral member 104. This impact may cause localized crushing of a Hexacomb® structure within the lateral member 104, thereby mitigating (e.g., dampening, decreasing, etc.) the impact before the impact is transferred to the base package 102. The corner inserts 1102 and the spacers 1104 further mitigate (e.g., dampen, decrease, etc.) the impact transferred from the base package 102 to the product 1100. This multi-tiered approach to protecting the product 1100 from impact provides substantial improvements to the impact resistance of the product while minimizing the costs associated with the cooperative packaging system 100.

In some alternative embodiments, the cooperative packaging system 100 includes another pair of encapsulating members that are configured to cover the transverse members 106. In this way, this additional pair of encapsulating members can cooperative with the encapsulating members 108 to completely contain the lateral members 104 and the transverse members 106.

As utilized herein, the terms "approximately," "about," "parallel," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. It is understood that the term "parallel" is intended to encompass de minimus variations as would be understood to be within the scope of the disclosure by those of ordinary skill in the art.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments and that such variations are intended to be encompassed by the present disclosure.

The construction and arrangement of the elements of the cooperative packaging system 100 and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Other substitutions, modifications, changes, and omissions may also be made in the design, operating conditions, and arrangement of the various exemplary embodiments without departing from the scope of the present invention. For example, any element (e.g., the lateral members 104, the transverse members 106, the encapsulating members 108, the risers 1000, the corner inserts 1102, the spacers 1104, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

What is claimed is:

1. A cooperative packaging system comprising:

a base package comprising a first face, a second face opposite the first face, a first side contiguous with the first face and second face, and a second side contiguous with the first side, the first face, and the second face;

a first member that covers a portion of the first side of the base package;

a second member that covers the second side of the base package; and a third member that covers the first member and a portion of the second member;

wherein the first member and the second member are configured to mitigate impacts sustained by the cooperative packaging system prior to the impacts being transferred to the base package.

2. The cooperative packaging system of claim 1, further comprising a fourth member;

wherein the base package further comprises a third side opposite the first side of the base package and a fourth side opposite the second side of the base package, such that the base package is rectangular;

wherein the fourth member covers the fourth side of the base package; and wherein the third member also covers a portion of the fourth member.

3. The cooperative packaging system of claim 2, further comprising a fifth member that covers a portion of the third side of the base package; and wherein the fifth member is configured to mitigate impacts sustained by the cooperative packaging system prior to the impacts being transferred to the base package.

4. The cooperative packaging system of claim 3, further comprising a sixth member that covers the fifth member, a portion of the fourth member, and a portion of the second member.

5. The cooperative packaging system of claim 4, further comprising a plurality of bands coupled to the third member and the sixth member, the plurality of bands configured to:

bias the third member against the first member to bias the first member against the base package; and bias the sixth member against the fifth member to bias the fifth member against the base package.

6. The cooperative packaging system of claim 5, wherein the plurality of bands are configured to bias the third member against the second member and against the fourth member; and wherein the plurality of bands are configured to bias the sixth member against the second member and against the fourth member.

7. The cooperative packaging system of claim 6, wherein the base package comprises:

a corner insert;

a spacer; and a product having a corner;

wherein the corner insert is positioned over the corner of the product, the corner insert separating the product from the base package; and wherein the spacer is positioned between the product and the base package.

8. The cooperative packaging system of claim 3, wherein the first member is identical to the fifth member; and wherein the second member is identical to the fourth member.

9. The cooperative packaging system of claim 8, wherein the first member, the second member, the fourth member, and the fifth member are constructed from honeycomb corrugate material.

10. The cooperative packaging system of claim 1, wherein the first member comprises:

a first surface in confronting relation with the base package;

a second surface in confronting relation with the base package, the second surface contiguous with the first surface;

a third surface in confronting relation with the base package, the third surface contiguous with the second surface;

a fourth surface opposite the first surface;

a fifth surface opposite the second surface and contiguous with the forth surface; and a sixth surface opposite the third surface and contiguous with the fifth surface.

11. The cooperative packaging system of claim 10, wherein the first member further comprises a first channel and a second channel;

wherein the first channel is contiguous with both the fourth surface and the fifth surface; and wherein the second channel is contiguous with both the fifth surface and the sixth surface.

12. The cooperative packaging system of claim 11, wherein the second member comprises:

a first surface in confronting relation with the base package;

a second surface in confronting relation with the base package, the second surface of the second member contiguous with the first surface of the second member;

a third surface in confronting relation with the base package, the third surface of the second member contiguous with the second surface of the second member;

a fourth surface opposite the first surface of the second member;

a fifth surface opposite the second surface of the second member and contiguous with the forth surface of the second member; and a sixth surface opposite the third surface of the second member and contiguous with the fifth surface of the second member.

13. The cooperative packaging system of claim 12, wherein the second member further comprises a first channel and a second channel;

wherein the first channel of the second member is contiguous with both the first surface of the second member and the second surface of the second member; and wherein the second channel of the second member is contiguous with both the second surface of the second member and the third surface of the second member.

14. A cooperative packaging system comprising:

a base package comprising:

a first side;

a second side contiguous with the first side;

a third side contiguous with the second side;

a fourth side contiguous with the third side and the first side;

a first surface contiguous with the first side, the second side, the third side, and the fourth side; and a second surface contiguous with the first side, the second side, the third side, and the fourth side;

a first member that partially covers a portion of the first surface, a portion of the second surface, and a portion of the first side;

a second member that covers the second side and partially covers a portion of the first surface and a portion of the second surface; and a third member that covers the first member and partially covers the second member.

15. The cooperative packaging system of claim 14, further comprising:

a fourth member that partially covers a portion of the first surface, a portion of the second surface, and a portion of the third side; and a fifth member that covers the fourth member and partially covers the second member.

16. The cooperative packaging system of claim 15, further comprising a sixth member that covers the fourth side and partially covers a portion of the first surface and a portion of the second surface;

wherein the third member partially covers the sixth member; and wherein the fifth member partially covers the sixth member.

17. The cooperative packaging system of claim 16, wherein the first member is identical to the fourth member;

wherein the second member is identical to the sixth member; and wherein the third member is identical to the fifth member.

18. A cooperative packaging system comprising:

a base package comprising a first face, a second face opposite the first face, a first side contiguous with the first face and second face, and a second side contiguous with the first side, the first face, and the second face;

a first member comprising:

a first surface that covers a portion of the first side of the base package;

a second surface that covers a portion of the first face of the base package; and a third surface that covers a portion of the second face of the base package;

a second member that covers the second side of the base package; and a third member that covers the first surface and a portion of the second member.

* * * * *